US005959595A

United States Patent [19]

Witschen et al.

[11] Patent Number: 5,959,595

[45] Date of Patent: Sep. 28, 1999

[54] ANTENNA METALIZED FIBER MAT REFLECTIVE APPLIQUE

[75] Inventors: Steven Witschen, Southern Pines; P. Marvin Walden, III, Angier; Robert W. Martin, Sanford, all of N.C.

[73] Assignee: Marconi Aerospace Systems, Inc., Austin, Tex.

[21] Appl. No.: 08/984,738

[22] Filed: Dec. 4, 1997

[51] Int. Cl.[6] ..... H01Q 15/14

[52] U.S. Cl. ..... 343/912; 343/897; 29/600

[58] Field of Search ..... 343/912, 915, 343/872, 897; 29/600; 428/246; 156/142

[56] References Cited

U.S. PATENT DOCUMENTS

| | | | |
|---|---|---|---|
| 2,772,987 | 12/1956 | Whitehurst et al. . | |
| 3,112,221 | 11/1963 | Price | 117/217 |
| 3,587,098 | 6/1971 | Gosnell . | |
| 3,599,218 | 8/1971 | Williamson et al. . | |
| 3,806,928 | 4/1974 | Costanza . | |
| 3,913,108 | 10/1975 | Branen . | |
| 3,916,418 | 10/1975 | Erdmann et al. . | |
| 4,030,953 | 6/1977 | Rutschw et al. . | |
| 4,092,453 | 5/1978 | Jonda . | |
| 4,171,563 | 10/1979 | Withoos . | |
| 4,188,358 | 2/1980 | Withoos et al. . | |
| 4,255,752 | 3/1981 | Noble et al. . | |
| 4,274,099 | 6/1981 | Downs . | |
| 4,620,890 | 11/1986 | Myers et al. . | |
| 4,647,329 | 3/1987 | Oono et al. . | |
| 4,763,133 | 8/1988 | Takemura et al. | 343/912 |
| 4,789,868 | 12/1988 | Oono et al. | 343/912 |
| 4,888,234 | 12/1989 | Smith et al. . | |
| 5,162,810 | 11/1992 | Onisawa | 343/912 |
| 5,178,709 | 1/1993 | Shimodaira et al. | 343/912 |
| 5,344,685 | 9/1994 | Cassell . | |
| 5,440,801 | 8/1995 | Marks et al. . | |
| 5,554,997 | 9/1996 | Cobb . | |

FOREIGN PATENT DOCUMENTS

| | | | |
|---|---|---|---|
| 0102002 | 6/1985 | Japan | 343/912 |
| 0203004 | 10/1985 | Japan | 343/912 |

*Primary Examiner*—Don Wong
*Assistant Examiner*—Tan Ho
*Attorney, Agent, or Firm*—Locke Liddell & Sapp LLP

[57] ABSTRACT

One aspect of the invention relates to a reflective mat useful to provide an electromagnetically reflective surface on a high-frequency radio antenna. In one version of the invention, the reflective mat includes a conductive mat shaped to conform to a signal receiving surface of an antenna core. The conductive mat has a core contacting surface, which is coated with an adhesive material for joining the conductive mat to the receiving surface, and a signal reflecting surface which is coated with a curable finishing material.

17 Claims, 4 Drawing Sheets

ANTENNA METALIZED FIBER MAT REFLECTIVE APPLIQUE

FIELD OF THE INVENTION

The invention relates generally to the field of antennas and more particularly to durable reflective surfaces useful with antenna cores. Still more particularly, the invention relates to reflective surfaces which include metalized fiber mats which are coated with a thermoset resin system that is partially cured before being applied to the antenna core.

BACKGROUND OF THE INVENTION

With the ever increasing use of high frequency radio communications there is a need for low cost, high performance antennas. Generally, high frequency antennas are constructed in the familiar dish shape to focus the received radio frequency ("RF") energy by reflection onto an electronic receiver which then passes the radio signal to other electronic components to extract the data contained in the signal. In order to maximize the amount of RF energy reflected by the antenna, the electromagnetically reflecting surface of the antenna is provided with a metallic material, such as aluminum or nickel.

Modem low-cost, high-frequency antennas, such as those used in satellite dishes, are typically constructed as shown in FIG. 1. FIG. 1 depicts a high frequency antenna 100 in cross-section. The antenna 100 includes a core 102 which forms the parabolic dish shape used to receive and reflect the high frequency RF signals. As used herein the term "core" refers to the structural depending on the manufacturing technology used, the core 102 is normally either attached to, or formed integrally with, other structural portions of the antenna, such as mounting structures 104 which are used to attach the antenna to desired positioning equipment that establishes the core's physical location and orientation.

While numerous variations are possible, conventional low cost cores are normally constructed from a molded plastic material which is provided with a signal receiving surface, in this case parabolic surface 106, designed to reflect selected frequencies of electromagnetic radiation from the parabolic surface 106 to an electronic receiver 110. The receiver 110 then passes the received signal to other electronic components, such as amplifies, demodulators, etc., which process the signal into a usable form.

Since plastic is not itself electrically conductive, its electromagnetically reflective properties are poor. Therefore, the parabolic surface of the core must be made conductive by either molding a conductive material into the parabolic surface, or painting the parabolic surface with a conductive material. Neither of these techniques for manufacturing antennas are completely satisfactory.

The process of molding in a conductive material requires the use of a compression molding process. In compression molding, a two piece mold is normally used, and each piece of the mold corresponds to one-half of the antenna core 102. Therefore, when the molds are assembled, they create a cavity that is the same size and shape of the desired antenna core. In operation, the conductive material to be used as the reflective surface, for instance, a wire mesh, is placed in the mold half that forms the reflecting surface of the antenna core. An amount of plastic molding material is then placed into the other half of the mold and the mold halves are compressed together, forcing the plastic material into the desired core shape. After the plastic cures, the molds are separated and the plastic antenna core is removed. It will be clear that the wire mesh is permanently formed into the reflecting surface of the antenna core during the process.

However, the compression molding process for forming antenna cores suffers from several drawbacks. First, the process is only suitable with certain types of plastic materials referred to sheet molding compounds ("SMCs"). These compounds are relatively low in viscosity and precise weights of the SMC material must be provided for each mold. Generally, pieces of the SMC material are hand cut to match a given mold. This is a time consuming process which adds to the cost of the completed antenna core. Moreover, even after the core is fabricated using the compression molding process, the reflecting surface must still be painted in order to protect the reflecting material from environmental pollutants, such as moisture, airborne chemicals, and the like. The paints commonly used in the art often involve the release of volatile organic compounds ("VOCs") which are environmentally undesirable.

SUMMARY OF THE INVENTION

Accordingly, it is one object of the invention to provide a durable, reflective material which is easily applied to an RF antenna core, such as a satellite dish. It is another object of the invention to provide a material to be applied to the antenna core to produce a substantially finished RF reflecting surface for the antenna, without requiring additional steps for providing an adhesive to the material, or painting the material. It is still a further object of the invention to provide techniques for creating a reflective surface on an antenna core without the use of environmentally harmful materials common in the art. It is also an object of the invention to provide methods for creating a reflective surface on an antenna using very low cost tooling to reduce the cost of the final cost of the antenna. The invention achieves these objects and provides other improvements and advantages which will become clear in view of the following disclosure.

One aspect of the invention relates to a mat which is applied to the signal receiving surface of the antenna core to create an electromagnetically reflective surface on the antenna core. In one embodiment, the mat is formed from a material which is naturally conductive, such as a stainless steel mesh. In an alternate embodiment, the mat is formed from a fabric or fibrous material which is made conductive by coating the fibers of the mat with a conductive material. For example, in one particular embodiment, the mat is formed from a non-woven fiberglass material, and the individual glass fibers are coated with metal to provide the mat with the required electrical conductivity.

The mat is then covered with a material which provides not only a smooth protective finish, but also functions as an adhesive to secure the mat to the surface of an antenna core. In one exemplary embodiment, polyester powder paints are used to provide both suitable adhesion and finish.

Another aspect of the invention relates to an antenna which has an electromagnetically reflective surface that includes a mat as described above. In one embodiment, the mat is permanently applied to an antenna core with heat and pressure. Since the mat already is coated with a protective finish, there is no need for the extra production step of painting the reflective surface. Moreover, since there is no need to paint the surface, the VOCs often used in the painting process are avoided.

DETAILED DESCRIPTION OF EMBODIMENTS OF THE INVENTION

Figure 1:
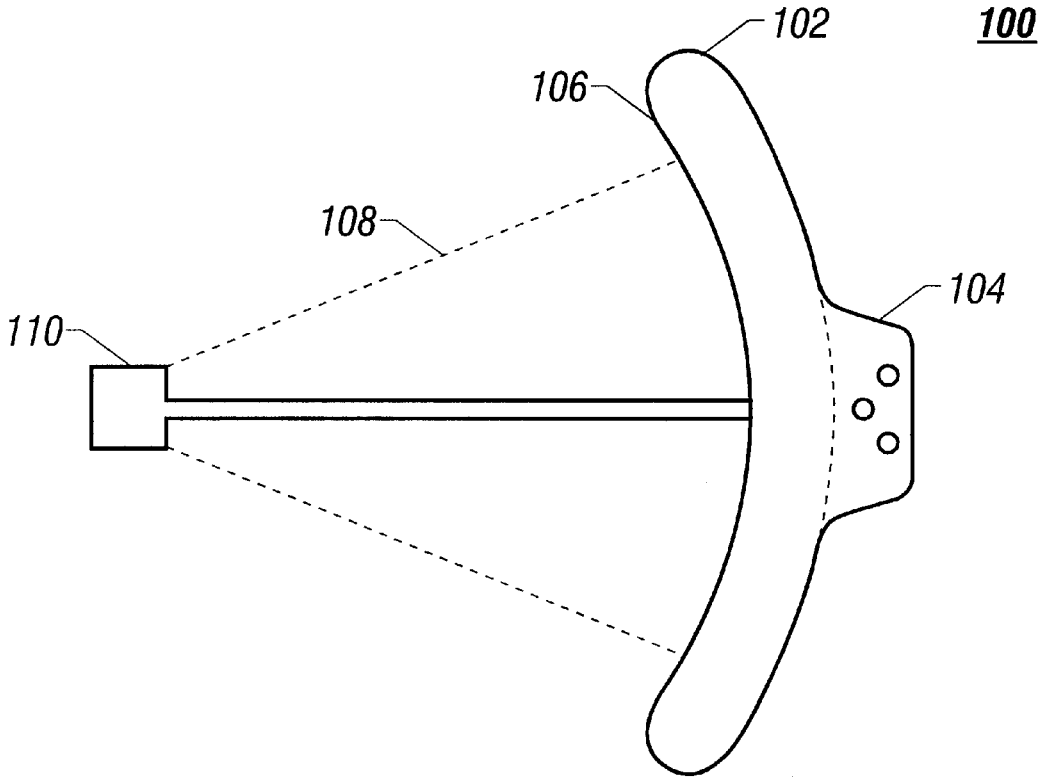
FIG. 1 is a cross-sectional view of a conventional high frequency antenna.
Figure 2:
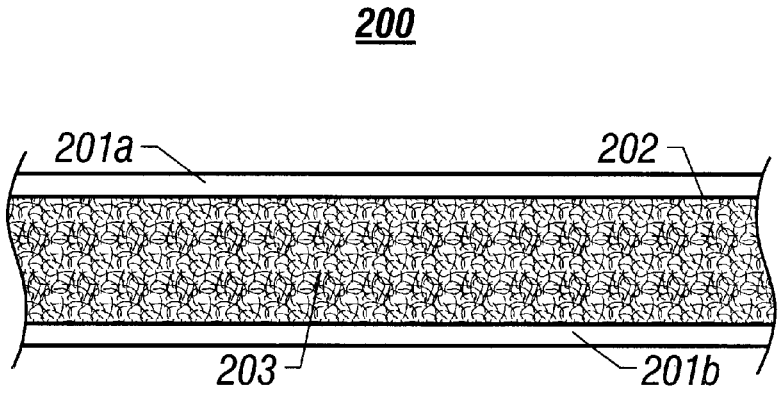
FIG. 2 is a cross-sectional view of a segment of a reflective mat according to an embodiment of the invention.

Referring now to FIG. 2, there is shown a cross-sectional view of a portion of a mat 200 according to an embodiment of the invention. The reflective mat 200 comprises an underlying conductive mat 202. The conductive mat 202 is advantageously formed from a plurality of fibers 203 which are either electrically conductive themselves, or are made electrically conductive by suitable metallic coatings. Each side of the conductive mat 202 is coated with a material 201*a,* 201*b* which has suitable adhesive and finishing properties, i.e., will provide a suitable aesthetic and environmentally protective covering to the underlying conductive mat 202 while at the same time provide a layer of adhesive material to join the mat to the signal receiving surface of the antenna core.

A number of different conductive mats 202 may be used as matter of design choice according to different versions of the invention. In general, the mats 202 will be electrically conductive, fairly lightweight, and capable of being cut and shaped as required to conform to the parabolic surface of the antenna core. The conductive mats 202 are constructed from a plurality of strands, or fibers, which may be woven or non-woven. Suitable woven mats include metallic meshes, such as a stainless steel or aluminum mesh, or non-conductive meshes constructed from, for example, fiberglass, in which the individual fibers or strands of the mat are provided with a conductive coating in order to make the mat electrically conductive. For example, one particularly useful mat is formed from nickel coated carbon fibers, and is commercially available from Technical Fiber Products.

Although useful, woven mats are relatively expensive, and, therefore, non-woven mats are used according to other advantageous embodiments of the invention. One particularly useful non-woven mat is formed from aluminum coated, i.e., "aluminized", glass fibers which are cut to specific lengths and formed into a mat in a conventional wet lay process.

Figure 3:
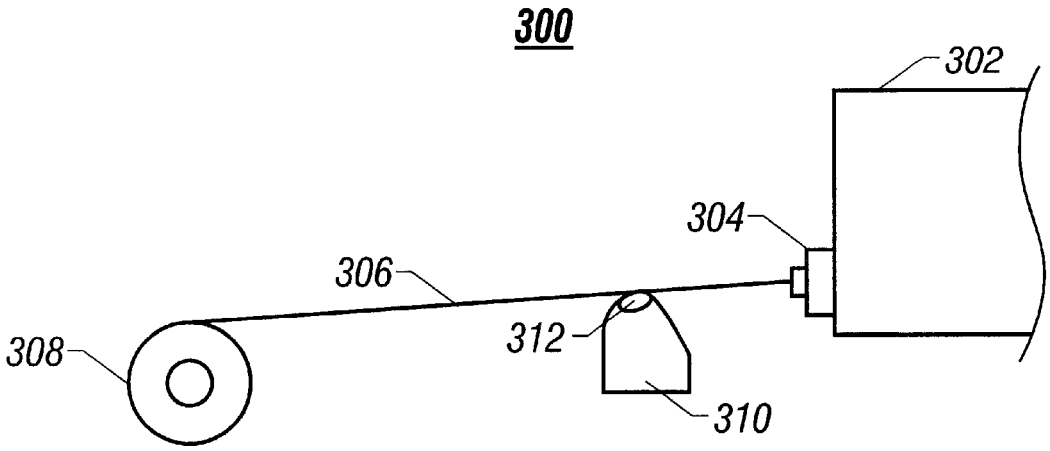
FIG. 3 depicts an apparatus for creating glass fibers useful to an embodiment of the invention.

FIG. 3 shows a block diagram of a system for making aluminized glass fibers. Only the major features of the system are shown for the sake of clarity. Such systems are well known and are described in detail in various publications in the art, for example, U.S. Pat. No. 2,772,987, to Whitehurst et al., incorporated herein by reference. A suitable glass material is placed into a furnace 302 where it is melted. The molten glass is drawn out as a strand, or fiber, of a desired diameter, through an orifice 304 connected to the furnace 302. The glass fiber 306 is then wound around a take up reel 308 as it exits the orifice 304. The fiber 306 is drawn across a lip 310 having a channel 312 formed therein which contains a molten material, such as aluminum. The surface tension of the molten aluminum allows it to extend slightly above the upper edge of the lip 310. Thus, the strand 306 can be lowered into the molten aluminum 312 to any desired depth. This allows the fiber 306 to be partially or completely coated by the metal, as a matter of design choice. In one advantageous embodiment, the fiber 306 is only partially coated with the metal material since coated fibers tend to have greater mechanical strength than fully coated fibers. However, this is not critical to the invention, and fully-coated fibers could be used as well.

The material used to make the fibers, may be any material suitable for making fiberglass. In one advantageous embodiment, the glass material is a calcium alumino-borosilicate material, referred to in the art under the ASTM designation "E" glass. Other suitable glasses, referred to by their ASTM designations, include "C" glass, "S" glass", and "D" glass. Any of these glasses may be selected as a matter of design choice depending on such factors as whether chemical resistance or mechanical strength is deemed to be an important property for the final intended use of the antenna. Additionally, it will be recognized that any suitable metal can be used to provide the necessary conductive surface to the glass fiber 306. In one particular useful embodiment, the material is commercially pure aluminum alloy 1350.

The diameter of the fiber 306 is not critical and may be selected as a matter of design choice. In one advantageous embodiment, the diameter of the fibers is between about 0.0004 inches to about 0.001 inches. In an even more specific embodiment, the fiber 306 is about 0.00073 inches, while the thickness of the metal coating is about 0.00025 inches.

The fiber 306 is then cut into sections of predetermined length. According to the present invention, the length of the fiber sections should be at least one-quarter of the wave length of the electromagnetic signal that the mat is intended to reflect. However, fiber sections shorter than this will still be acceptable when combined with other fibers in a matrix.

The fiber sections are then formed into a mat according to processes which are well known in the art. For example, one category of suitable processes are "wet lay" process. These processes involve placing the fiber sections in an aqueous slurry with a lubricant such as a phosphoric acid material, to prevent fiber to fiber cohesion in the slurry. Aluminum coating cold end welding is performed chemically in the aqueous solution of the slurry. Afterwards, the fibers are removed from the first solution, dried on a wire conveyor, then placed into a second aqueous solution which creates the actual fiber-to-fiber bonding coherence necessary to form the conductive mat. The second aqueous solution is then removed by the application of heat, leaving a mat of bound fibers of the desired thickness. In one advantageous embodiment, the mat is about 0.030 inches thick. More specific details of the wet lay process will be familiar to those of skill in the art, and will not be described in greater detail herein.

Another category of processes suitable for forming the mat are "dry lay" processes. Dry lay processes are well known and will not be described herein. However, it should be noted that wet lay processes tend to produce mats with a denser, paper-like texture which is preferred over mats produced by the dry lay process which produces mats with a loftier or "fluffier" texture.

After the conductive mat 202 has been selected, it is coated with a material which provides the conductive mat 202 with a protective covering, as well as a layer of adhesive to join the conductive mat 202 to the parabolic surface of an antenna core. This material will be referred to herein as the "finishing" material. Of course, it will be recognized that two separate materials 201*a* and 201*b* can be applied to the conductive mat 202, one material providing the adhesive layer, and the other providing the appropriate protective finish. However, to simplify the manufacturing process, it is desirable that a single finishing material is used. Thus, desirable finishing materials will not only have acceptable qualities with respect to aesthetic finish, environmental durability and protection of the conductive mat 202, but will also have good adhesive properties to permit the reflective mat to be permanently affixed to an antenna core.

One category of suitable finishing materials includes polyester thermosetting powder coat paints, such as PPL9675G, commercially available from Spraylat Corporation. These powder coat paints are applied to the mat in a manner substantially described with respect to FIG. 5.

Figure 5:
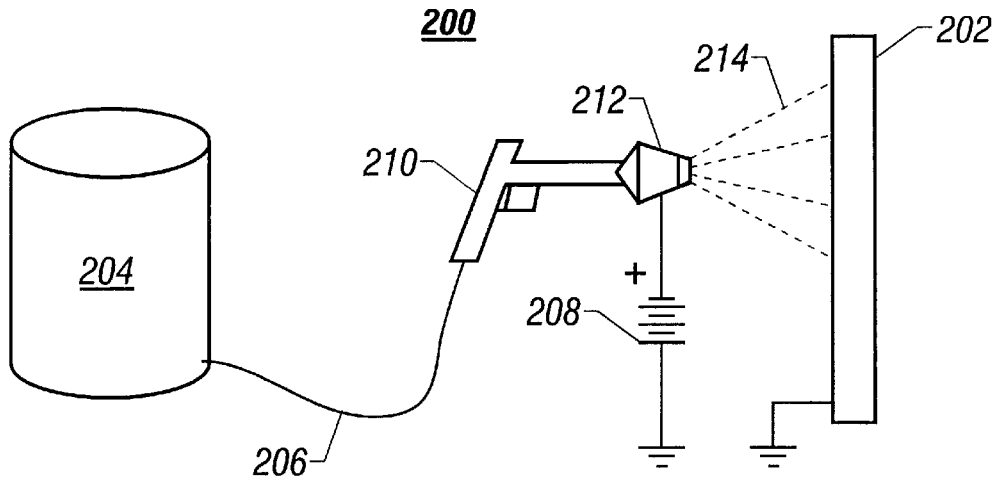
FIG. 5 is a schematic diagram illustrating a coating process useful to create a reflective mat according to an embodiment of the invention.

Referring now to FIG. 5, there is shown a process for electrostatically applying a finishing material to a conductive mat 202 according to an embodiment of the invention. The figure depicts a simplified powder spray system, having a tank 204 for containing a suitable powder coating. The tank 204 is connected to a transport line 206 which feeds the coating to a spray gun 210 under pneumatic pressure. The spray gun 210 is provided with a nozzle 212 which is connected to a power supply 208. Pneumatic pressure is used to force the powder coating from the tank 204 to the transport line 206 and out of the spray gun 210. When the powder particles 214 are ejected from the nozzle 212, they are charged by power supply 208. The mat 202 is connected to a ground. This causes electrostatic adherence of the particles 214 to the mat 202. Numerous suitable powder spray systems are well known in the art, for example, the Versa-Spray, commercially available from Nordson Corporation. The process parameters used in the powder spray process are, naturally dependent on the particular equipment and powder coat material selected. In one particular version of the invention, it has been found that a voltage differential of 40–60 kv is useful.

Those familiar with thermosetting polyester paints will appreciate that after the finishing material is applied to the conductive mat 202, it must be "cured" with the application of heat. The heat activates the catalysts contained in the finishing material which cause the material to harden and set into a final protective layer. Before any curing has been formed, the conductive mat 202 could be cut into the desired shape and applied to the antenna core as an applique, as will be discussed in greater detail further herein. However, if the finishing material is uncured, it is difficult to maintain the paint presence during handling and transportation of the reflective mat.

At the same time, however, since the polyester powder is also to be used as an adhesive to attach the reflective mat to the antenna core, it is not desirable to completely cure the polyester powder before attachment to the core. Accordingly, in one advantageous embodiment to the invention, after the powder coat is sprayed onto the aluminized fiberglass mat, the mat is heated to a point that is high enough to cause the polyester material to begin to flow, but not high enough to fully activate the catalyst material in the powder that causes the powder coat to harden. Heating may be performed by a conventional infrared or direct heat oven. Heating the powder coat material to a point sufficient to allow it to flow, without completely curing, is referred to as a "partial cure". As the material begins to flow, minute gaps in the sprayed coating caused by the roughness of the underlying conductive mat and imperfections in the coating process are filled in. This creates a smooth, well-adhered finish to the conductive mat 202. Simultaneously, the polyester material increases its adherence to the mat so it becomes more durable and not as likely to be damaged during the handling.

The time and temperatures required for a partial cure will depend on the polyester powder selected for use, the underlying mat and the conditions and techniques used in coating the mat. It is believed within the skill of those in the art to select the appropriate time/temperature combination for specific powder coatings in view of the technical data sheets, cure cycle times, and other information provided by the powder coat manufacturer. In general, the temperature should be kept below the initiation of cure temperature for the material used. The mat is maintained at this temperature until the coating material has adhered to the mat such that the coating particles do not tend to fall off when the mat is handled. For example, with respect to Spraylat PPL9675G, a complete cure is obtained by subjecting the powder coated mat to a temperature of 395° F. for five minutes. An acceptable partial cure is obtained by subjecting the powder coated mat to a temperature of 300° F. for one minute.

Since it is important to cause the powder coat material to flow during the partial curing process, the amount of powder coat material placed on the aluminized fiber mat is important. If the powder coat application is too heavy, then the partial cure flow is degraded, and there is a waste of powder coat material. If the powder coating is too light, then again the flow is degraded. In one advantageous embodiment using an aluminized fiberglass mat substantially as described earlier, the powder coat material is applied to the aluminized fiberglass mat until there is approximately a 150% add-on by weight. In other words, the combined weight of the conductive mat and the powder coating is 150% heavier than the conductive mat itself. Alternately, the amount of spray may be measured in terms of the thickness of the powder coating material. In one advantageous embodiment, the powder coat material is about 0.045 inches thick after it has been sprayed onto the conductive mat.

In view of the above disclosure, it will be clear to those of skill in the art that other coating materials capable of providing an environmentally durable finish, as well as adhesion to the antenna core may be substituted for the thermosetting polyester powder coating, described above. For example, another category of suitable finishing materials include thermosetting resin systems, such as "GELCOAT," commercially available from Reichhold Corporation. Other suitable thermosetting resin systems will occur to those of skill in the art and particular systems may be selected as a matter of design choice. Although there are specific differences, in general these systems involve binding a thixatropic agent, i.e., a thickening agent, to a coating resin, then applying the resin to the conductive mat. In this case, a catalyst is also added to the resin to cause the resin to cure into a hardened finish. The use of thermosetting resin systems differs from the powder coat system in that the powder coat systems require the application of heat to achieve the precure stage. By contrast, with resin systems, precure is obtained by balancing the catalyst with a retarder so that the resin will flow suitably over the aluminized fiberglass mat, but will not actually harden into the finished coating, until heat is applied to the mat during its application to the antenna core.

Figure 4:
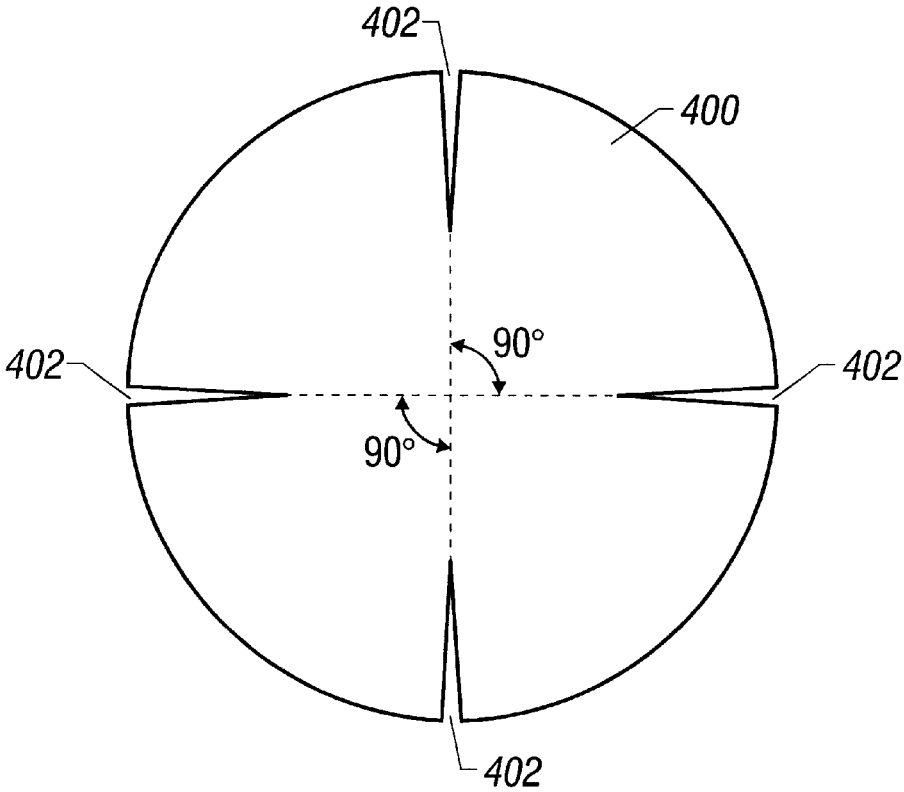
FIG. 4 is a top view of a reflective mat which has been cut to shape for attachment to an antenna core according to an embodiment of the invention.

After the reflective mat has been produced as described above, it is cut into shape suitable for application to a specific antenna core. FIG. 4 is a top view of a mat 400 which has been cut to fit the reflecting surface of a dish-shaped antenna core. As seen, the mat 400 itself, is not round, but is oval, and has cuts 402 formed therein to allow the mat 400 to be pressed tightly against the reflecting surface of the antenna core without wrinkling. Suitable mats will have sufficient flexibility to conform to the requisite antenna shape.

Figure 6:
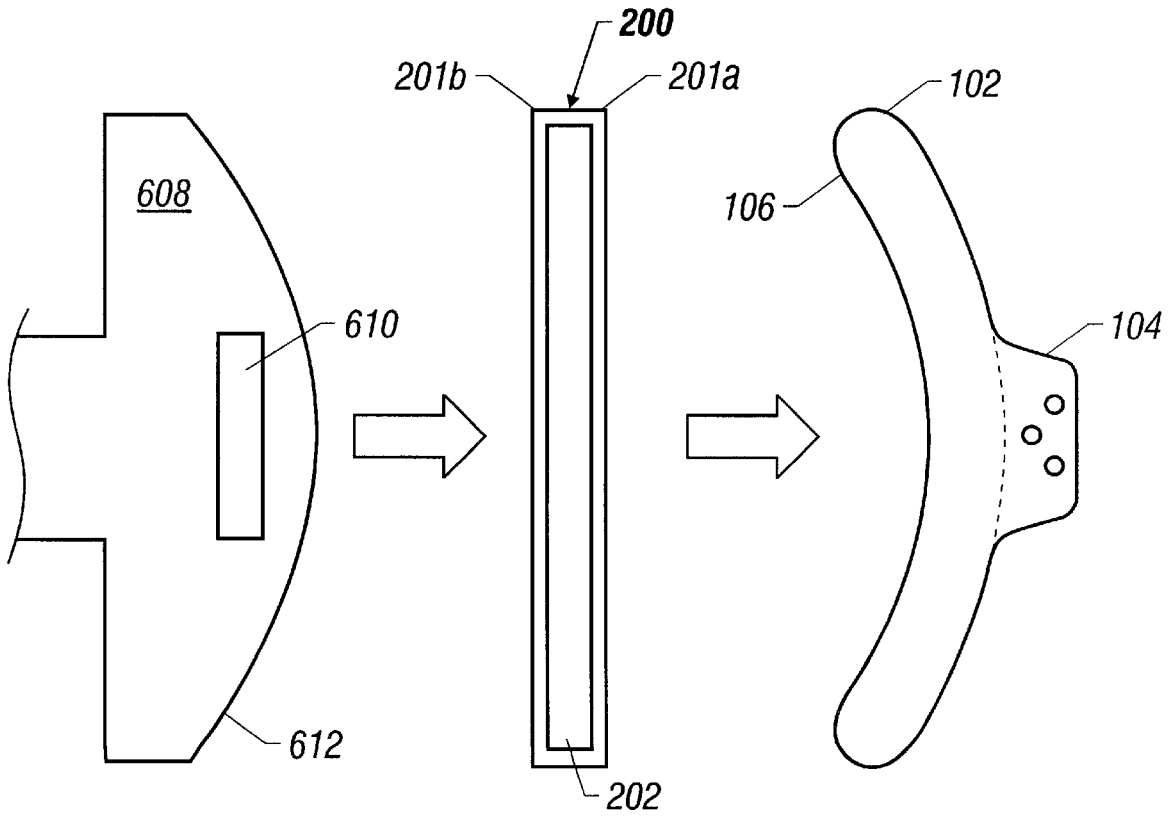
FIG. 6 is a diagram illustrating the application of a reflective mat to an antenna core according to an embodiment of the invention.
Figure 7:
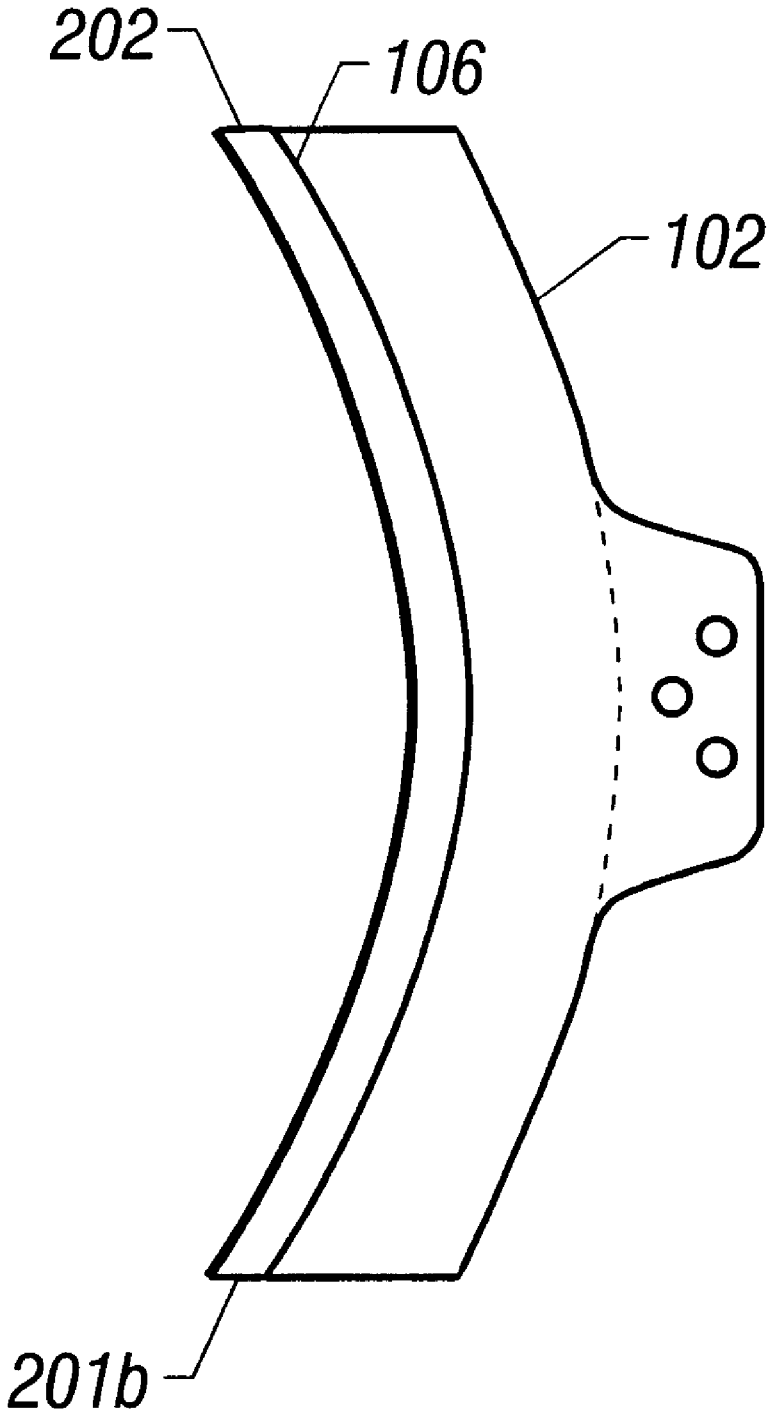
FIG. 7 is a cross-sectional view showing an antenna core having an reflective mat formed on its signal receiving surface according to an embodiment of the invention.

Referring now to FIG. 6, there is shown a method useful for applying a reflective mat 200 having a partially cured coating as an applique to an antenna core 102. Specifically, a reflective mat 200, having an underlying conductive mat 202, each side of which is coated with a finishing material 201*a,* 201*b,* is applied to the reflective surface 106 of an antenna core 102 by means of pressure provided by a heated tool 608. The tool 608 provides a male heated tooling surface 612 which accurately images the shape of the parabolic surface 106 of the antenna core 102. The mat contacting surface 612 of the tool 608 is heated by means of a heating element 610 constructed within the tool 608. The heating element 610 is formed from according to conventional techniques employing electrically resistive elements, steam or hot oil elements. The tool 608 presses the mat 200 into the parabolic surface 106 of the antenna core 102, while heating the mat 200 to thermally complete the curing of the finishing material. As the finishing material cures, the portion of the coating connecting the mat 200 to the parabolic surface 106 acts as an adhesive which permanently fixes the mat 200 to the antenna core 102. The side of the mat 200 which faces away from the core 102 is simultaneously finished to provide a durable, environmentally protective and aesthetically acceptable coating layer to the underlying conductive mat. The pressure and temperature applied by the tool 608 during this process will, of course, depend on the coating selected for the mat 200 and the amount of partial cure already applied. In one particular embodiment, employing a suitably precured Spraylat PPL9675G polyester material, the tool 608 is applied to the mat 200 at a force of about 150 psi at 400° F. for one minute. Afterwards, the tool 608 is removed, leaving the finished antenna having a permanently affixed mat 200 on the signal receiving surface 106 of the antenna core 102 as shown as in FIG. 7. The adhesive layer 201*a* is compressed in this operation to, for example, about 0.007 inches. Moreover, a protective finish layer 201*b* is also fully cured and ready for use. No further painting is required. It will be noted that fewer processing steps are required to attach mat 200 than required for conventional painting processes. Thus, the antenna manufacturing process has been simplified, thereby producing a high quality antenna at a lower cost, while avoiding the use of VOCs which are required by conventional painting processes.

Although the invention has been described with respect to specific embodiments, it will be understood by those of skill in the art that various changes can be made in form and detail without departing from the scope and spirit of the present invention. All publications discussed herein are hereby incorporated by reference as those set forth in full.

What is claimed is:

1. A partially cured reflective mat useful to provide an electromagnetically reflective surface on high frequency antennas, the reflective mat comprising:

a conductive mat shapeable to conform to a signal receiving surface of an antenna core, the conductive mat having a core contacting surface, which is coated with an adhesive material for joining the conductive mat to the signal receiving surface, and a signal reflecting surface which is coated with a finishing material wherein the conductive mat comprises a non-woven mesh of a plurality of conductive fibers which are at least one-quarter of the wave length of the electromagnetic signal that the mat is intended to reflect.

2. A reflective mat as in claim 1 wherein the adhesive material and the finishing material comprise a thermosetting polyester.

3. A reflective mat as in claim 1 wherein the adhesive material and the finishing material comprise a thermosetting resin.

4. A reflective mat as in claim 1 wherein the conductive mat comprises a material having a plurality of non-conductive fibers which are at least partially coated with a conductive material.

5. A reflective mat as in claim 1 wherein the conductive mat comprises a non-woven fiberglass material in which the fibers are at least partially coated with aluminum.

6. A high frequency antenna having an antenna core with a signal receiving surface, the signal receiving surface being at least partially covered with a reflective mat, the reflective mat comprising:

a conductive mat shaped to conform to a signal receiving surface of an antenna core, the conductive mat having a core contacting surface, which is coated with an adhesive material for joining the conductive mat to the signal receiving surface, and a signal reflecting surface which is a coated with a finishing material, the finishing material being partially cured before the reflective mat is joined to the antenna core, the conductive mat including a non-woven mesh having a plurality of conductive fibers that are at least one-quarter of the wave-length intended to be reflected by the mat.

7. An antenna as in claim 6 wherein the adhesive material and the finishing material comprise a thermosetting polyester.

8. An antenna as in claim 6 wherein the adhesive material and the finishing material comprise a thermosetting resin.

9. An antenna as in claim 6 wherein the conductive mat comprises a material having a plurality of non-conductive fibers which are at least partially coated with a conductive material.

10. An antenna as in claim 6 wherein the conductive mat comprises a non-woven fiberglass material in which the fibers are at least partially coated with aluminum.

11. A method for fabricating a radio frequency antenna, the method comprising:

providing a reflective mat which includes a conductive mat shaped to conform to a signal receiving surface of an antenna core, the conductive mat having a core contacting surface, which is coated with an adhesive material for joining the conductive mat to the signal receiving surface, and a signal reflecting surface which is coated with a finishing material;

attaching the contacting surface of the conductive mat to the signal receiving surface of the antenna core with a tool having a heatable surface configured as a male image of the signal receiving surface, the heatable surface being joined to the signal reflecting surface of the conductive mat;

heating the heatable surface until the reflective mat is permanently adhered to the antenna core and the finishing material on the signal reflecting surface is cured.

12. A method as in claim 11 further comprising the step of partially curing at least one of the adhesive material or the finishing material.

13. A method as in claim 11 wherein providing a reflective mat comprises coating the core contacting surface and the signal reflecting surface of the conductive mat with a thermosetting polyester material.

14. A method as in claim 11 wherein providing a reflective mat comprises coating the core contacting surface and the signal reflecting surface of the conductive mat with a thermosetting resin material.

15. A reflective mat useful to provide an electromagnetically reflective surface on high frequency radio antennas, the reflective mat comprising:

a conductive mat formed from a non-woven fiberglass material in which the fibers have been provided with a metallic coating, the conductive mat being shaped to conform to a signal receiving surface of an antenna core, the conductive mat having a core contacting surface and a signal receiving surface, each surface being coated with a partially cured finishing material.

16. A reflective mat as in claim 15 wherein the partially cured finishing material comprises a thermosetting polyester.

17. A reflective mat as in claim 15 wherein the partially cured finishing material comprises a thermosetting resin.

* * * * *